US006551118B2

(12) United States Patent
Langolf et al.

(10) Patent No.: US 6,551,118 B2
(45) Date of Patent: Apr. 22, 2003

(54) LEVER TYPE ELECTRICAL CONNECTOR

(75) Inventors: David Langolf, Ortonville, MI (US); Cameron Pendleton, Metamora, MI (US); Adam Tyler, Lake Orion, MI (US); Vishnu Naidu, Waterford, MI (US)

(73) Assignee: Molex Incorporated, Lisle, IL (US)

( * ) Notice: Subject to any disclaimer, the term of this patent is extended or adjusted under 35 U.S.C. 154(b) by 0 days.

(21) Appl. No.: 09/915,733

(22) Filed: Jul. 26, 2001

(65) Prior Publication Data

US 2003/0022538 A1 Jan. 30, 2003

(51) Int. Cl.[7] ..... H01R 13/62
(52) U.S. Cl. ..... 439/157
(58) Field of Search ..... 439/157, 372, 439/152

(56) References Cited

U.S. PATENT DOCUMENTS 5,110,301 A * 5/1992 Inoue et al. ..... 403/322.1
5,460,534 A * 10/1995 Taniuchi et al. ..... 439/157
5,938,458 A * 8/1999 Krehbiel et al. ..... 439/157
6,176,713 B1 * 1/2001 Okabe ..... 439/157
2001/0019989 A1 * 9/2001 Sasaki et al. ..... 439/157

FOREIGN PATENT DOCUMENTS

JP 2000-260523 9/2000 ..... H01R/13/629

* cited by examiner

*Primary Examiner*—Lynn D. Feild
*Assistant Examiner*—Phuong Dinh
(74) *Attorney, Agent, or Firm*—Stacey E. Caldwell

(57) ABSTRACT

A lever type electrical connector assembly includes a first connector having a housing with opposite sides. A single actuating lever is pivotally mounted on the housing intermediate the opposite sides thereof for pivotal movement about an axis extending in a direction between the opposite sides of the housing. The actuating lever includes a cam groove. A second connector mates with the first connector and has a cam follower projection to be engaged in the cam groove of the single actuating lever, whereby the connectors are mated and unmated in response to rotation of the actuating lever.

11 Claims, 4 Drawing Sheets

LEVER TYPE ELECTRICAL CONNECTOR

FIELD OF THE INVENTION

This invention generally relates to the art of electrical connectors and, particularly, to an electrical connector having a lever whereby mating and unmating of the connector with a second connector is effected by rotation of the lever.

BACKGROUND OF THE INVENTION

A typical lever type electrical connector assembly includes a first connector which has an actuating lever rotatably mounted thereon for connecting and disconnecting the connector with a complementary mating second connector. The actuating lever and the second connector typically have a cam groove/cam follower arrangement for drawing the second connector into mating condition with the first connector in response to rotation of the lever.

A common structure for a lever type electrical connector of the character described above is to provide a generally U-shaped lever structure having a pair of lever arms which are disposed on opposite sides of the first ("actuator") connector. The lever arms may have cam grooves for engaging cam follower projections or posts on opposite sides of the second ("mating") connector.

Such lever type connectors often are used where large forces are required to mate and unmate a pair of connectors. For instance, terminal and housing frictional forces encountered during connecting and disconnecting the connectors may make the process difficult to perform by hand. However, certain disadvantages result from the use of U-shaped lever structures as described above. Specifically, with the U-shaped lever structure having a pair of lever arms disposed on opposite sides of the actuator connector, the overall size or profile of the connector is significantly increased. This causes problems in many high-density applications where the connectors must be juxtaposed as close to each other as possible. In other applications, such over-sized connectors take up too much "real estate" on the boards or other support structures to which the mating connector is mounted.

One approach to solving these problems with U-shaped lever structures has been the use of "bolt-assist" systems. In other words, one or more bolt-like members are mounted on the actuator connector within the overall profile thereof for interengagement with the mating connector to draw the connectors into mated condition. Unfortunately, such bolt-assist systems create significant other problems. Specifically, tools such as air wrenches typically are used to rotate the bolt members. Often, such tools apply excessive forces which can irreparably crush the terminal of the connectors if the terminals are not properly seated. In addition, the bolt members are screw-machined components which add significantly to the costs of the connector. The use of tools or wrenches also adds to the costs and, sometimes, the wrenches are impractical to use.

The present invention is directed to solving these problems by providing a connector with a single lever mounted within the overall profile of the connector. The single lever system is easy to manufacture, easy to assemble and is cost effective.

SUMMARY OF THE INVENTION

An object, therefore, of the invention is to provide a new and improved lever-type electrical connector assembly of the character described.

In the exemplary embodiment of the invention, the connector assembly includes a first connector having a housing with opposite sides. A plurality of first terminals are mounted on the housing. A single actuating lever is pivotally mounted on the housing intermediate the opposite sides thereof for pivotal movement about an axis extending between the sides and including a cam groove therein. A second connector includes a plurality of second terminals for mating with the first terminals of the first connector. The second connector has a cam follower projection to be engaged in the cam groove of the actuating lever, whereby the connectors are mated and unmated in response to rotation of the actuating lever.

As disclosed herein, the first terminals are mounted on the housing of the first connector on opposite sides of the actuating lever. Specifically, the first terminals are mounted on the housing in a given terminal array. The actuating lever is located within the array of terminals. The terminals are disposed in the array in a load pattern upon mating with the second terminals of the second connector. The invention contemplates that the actuating lever be located generally on the load center-line of the load pattern.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENT

Figure 3:
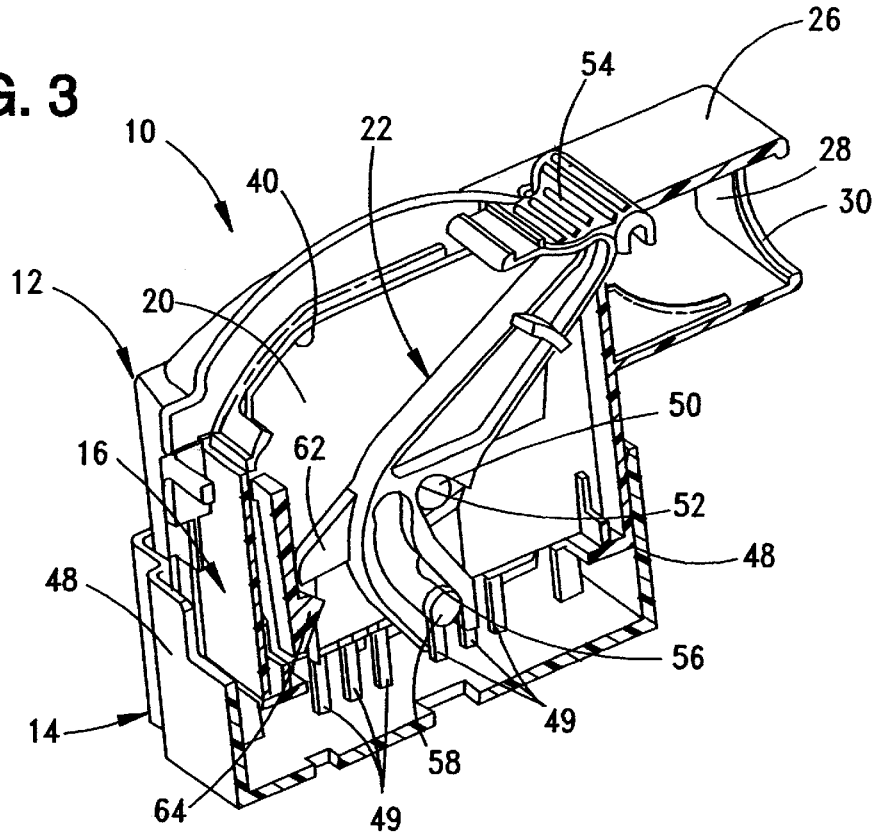
FIG. 3 is a vertical central section through a connector assembly incorporating the connector of FIGS. 1 and 2 and a second mating connector, in an unmated or preload position.
Figure 4:
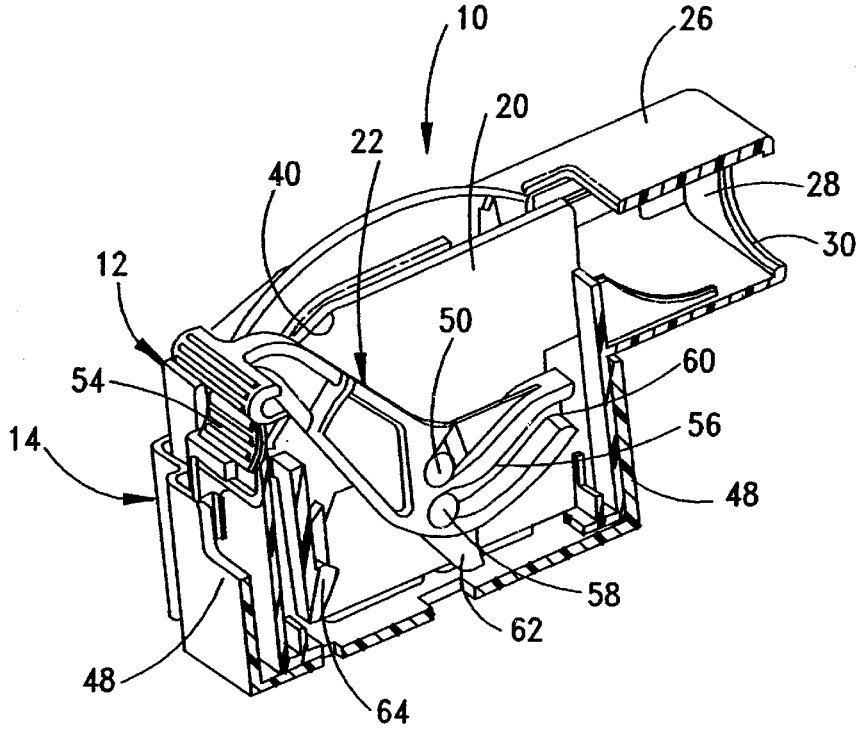
FIG. 4 is a view similar to that of FIG. 3, with the connector assembly in fully mated condition.

Referring to the drawings in greater detail, the invention is embodied in a lever type electrical connector assembly, generally designated 10 (FIGS. 3 and 4). The assembly includes a first ("actuator") connector, generally designated 12, and a second ("mating") connector, generally designated 14.

Figure 1:
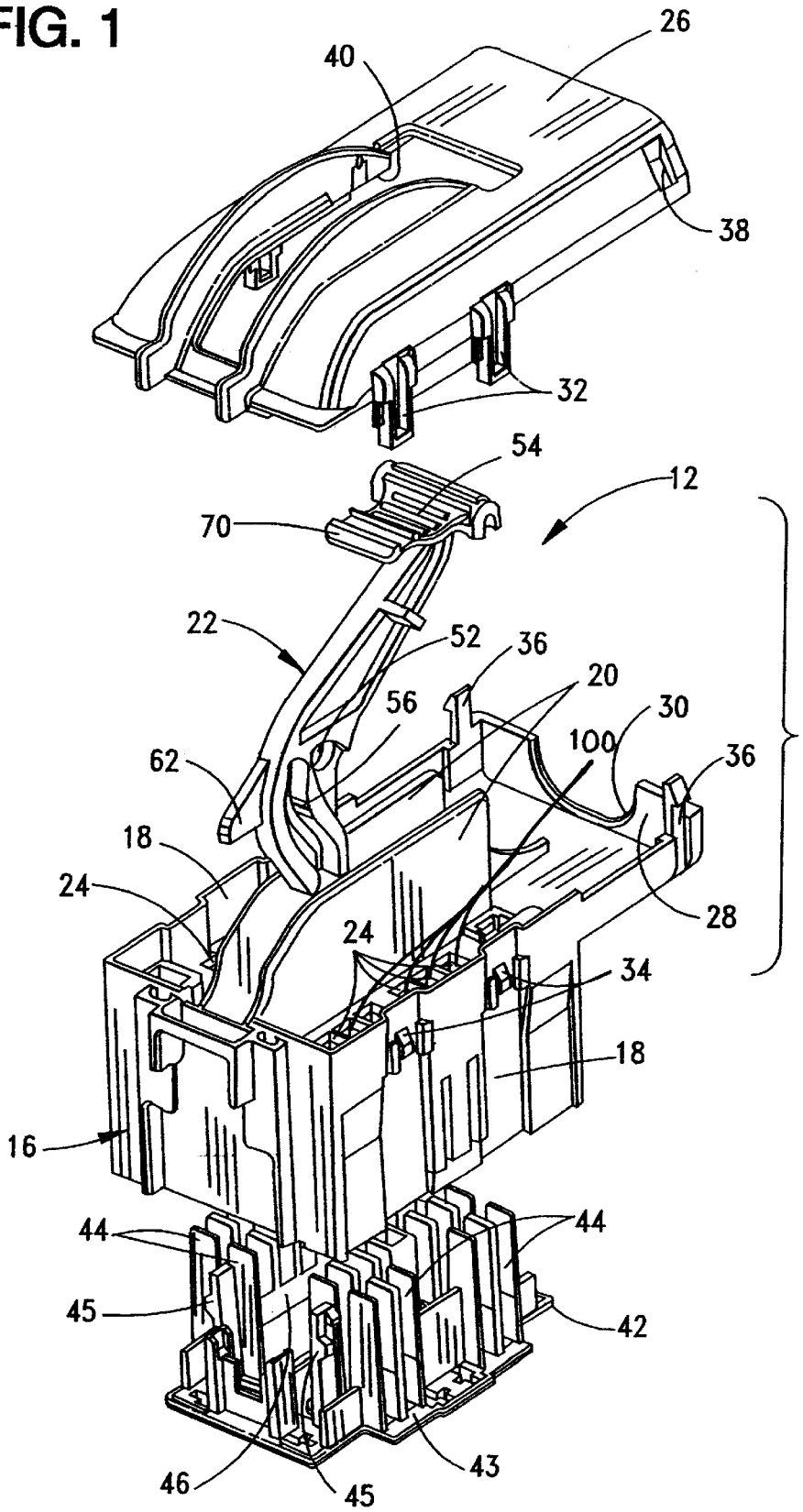
FIG. 1 is an exploded perspective view of a lever type electrical connector embodying the concepts of the invention.

Referring first to FIG. 1, actuator connector 12 includes a molded plastic housing, generally designated 16, which includes opposite sides 18 and a pair of interior, generally parallel walls 20 between which a single actuating lever, generally designated 22, is pivotally mounted as seen hereinafter. Housing 16 mounts a plurality of first terminals 100 within a plurality of terminal-receiving passages 24 on opposite sides of interior walls 20 and actuating lever 22.

Figure 2:
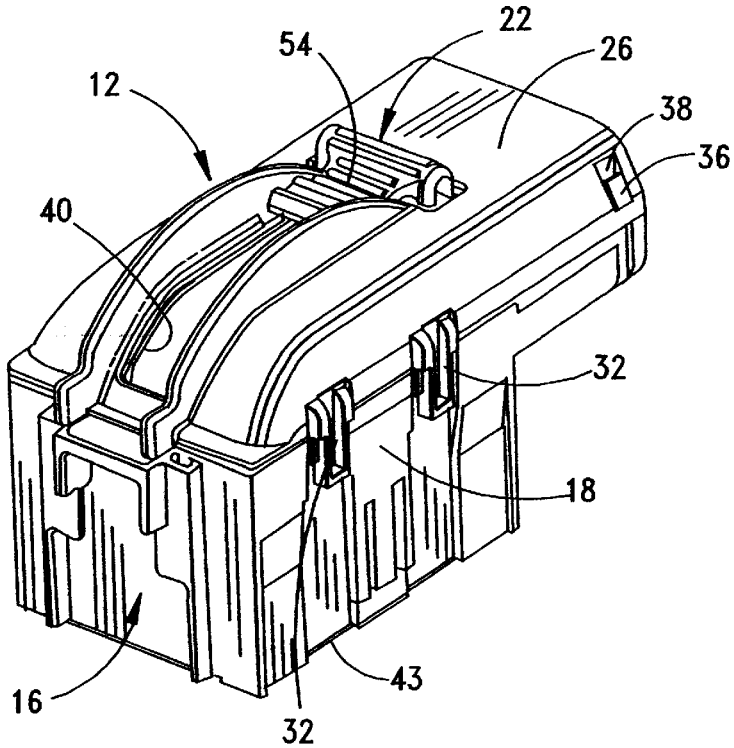
FIG. 2 is a perspective view of the connector in assembled condition.

Actuator connector 12 includes a shroud 26 which substantially covers the top of connector housing 16 and combines with a bracket portion 28 of the housing to provide an opening 30 for ingress/egress of an electrical cable having conductors terminated to the terminals 100 within passages 24 of the connector housing. The shroud has a pair of flexible latch arms 32 depending from each opposite side thereof for engaging a pair of latch bosses 34 on the outside of each side 18 of the connector housing. In addition, the housing has a pair of flexible latch arms 36 which project upwardly for engagement within a pair of latch holes 38 in shroud 26. Latch arms 32 and latch holes 38 of the shroud, and latch bosses 34 and latch bosses 38 of the connector housing combine to secure the shroud to the top of the housing, as seen in FIG. 2. Finally, the shroud is provided with an opening or slot 40 through which a manipulated portion of actuating lever 22 projects, also as seen in FIG. 2. Mating connector 14 includes a terminal position assurance (TPA) device 42 which includes a flat base 43 and a plurality of terminal-engaging blades 44 which assure that the terminals 100 are properly mounted in housing 16. The TPA device is inserted upwardly into the housing and held thereon by latch arms 45. The TPA device has a generally centrally located open area 46 which is aligned with the open area between interior walls 20 of actuator connector housing 16 and within which lever 22 is operative as described hereinafter. Interior walls 20 of the housing actually project downwardly into open area 46 of the TPA device.

FIGS. 3 and 4 show actuator connector 12 mateable with mating connector 14. The mating connector includes a plurality of side walls 48 within which a plurality of terminals 49 are mounted for engaging the terminals 100 of actuator connector 12.

FIG. 3 shows actuating lever 22 in its inoperative position when the connector assembly is unmated. FIG. 4 shows actuating lever 22 in its operative or fully mated position. The actuating lever is pivotally mounted on the housing by means of a pivot shaft 50 which is integral with and extends between parallel interior walls 20 of the housing. The pivot shaft extends through a pivot journal 52 formed in the actuating lever. Pivot shaft 50 is actually split in the middle to facilitate assembly of the actuating lever. The lever may be molded of plastic material and includes an integrally molded, convex head portion 54 exposed at the top of connector housing 16 to facilitate manual manipulation and movement of the lever between its inoperative and operative position. The actuating lever further includes a cam groove 56 which receives a cam follower projection 58 from mating connector 14.

Figure 5:
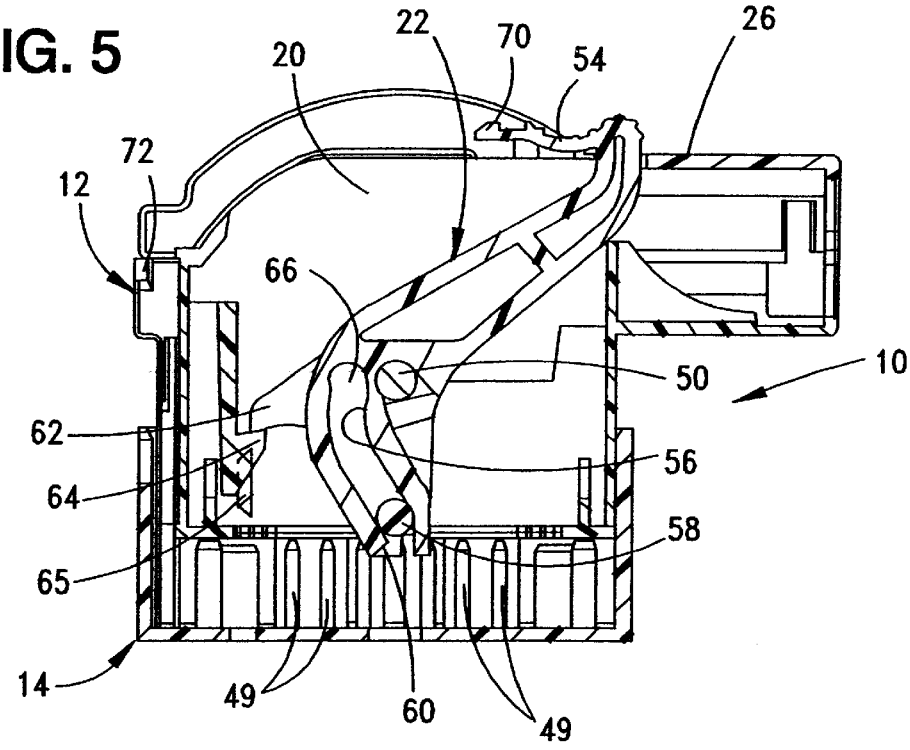
FIGS. 5–7 are sequential views of the connector assembly, showing movement of the single actuating lever from its inoperative or preload position to its operative or fully mated position.
Figure 6:
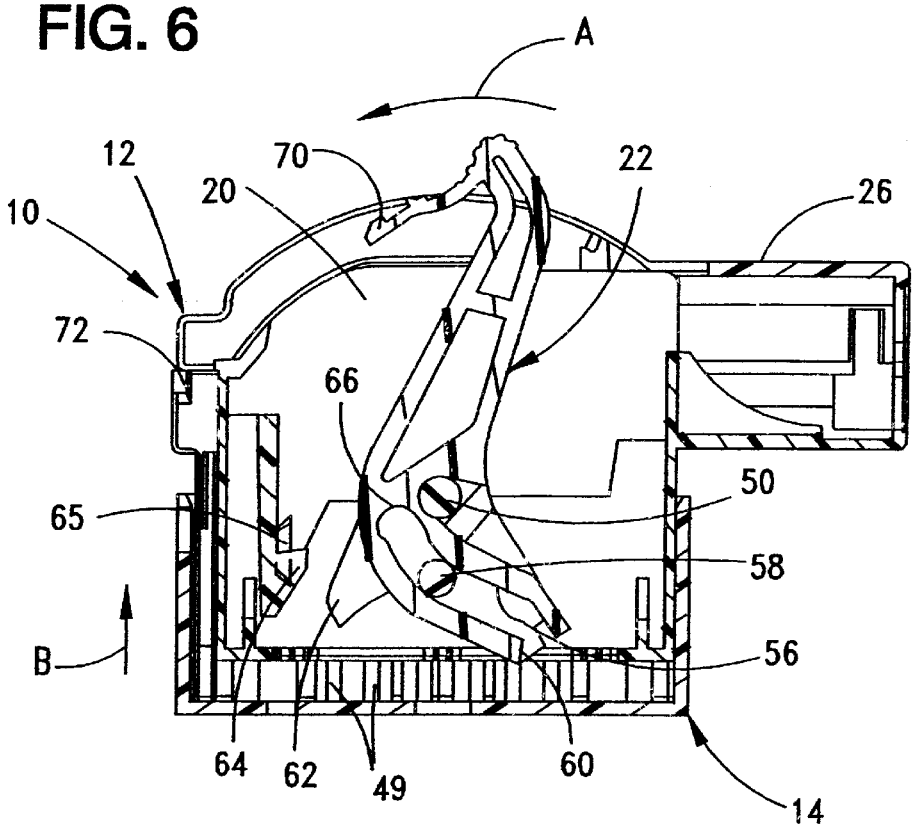
Figure 7:
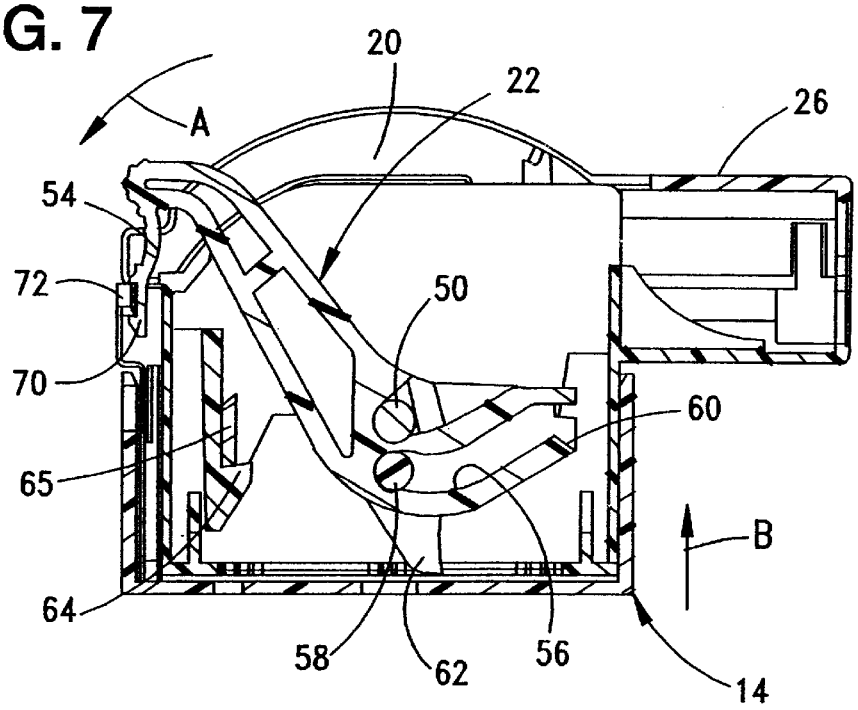

FIGS. 5–7 are sequential views showing the movement of actuating lever 22 between its inoperative position (FIG. 5) and its operative or fully mated position (FIG. 7) resulting in mating connector 14 mating with actuator connector 12. Specifically, FIG. 5 shows the actuating lever in its inoperative position. It can be seen that cam follower projection 58 of mating connector 14 has just entered a mouth 60 of cam groove 56 in the actuating lever. In the inoperative position, a detent projection 62 on the actuating lever engages a detent projection 64 on the interior of the housing to define this inoperative position of the lever. Therefore, the lever is held in a position so that cam follower projection 58 can easily enter mouth 60 of cam groove 56 when the connectors are pre-mated as shown in FIG. 5.

FIG. 6 shows actuating lever 22 having been pivoted about pivot shaft 50 in the direction of arrow "A". The actuating lever is approximately half-way between the pre-mated and the fully mated positions. It can be seen that cam follower projection 58 from the mating connector has moved approximately one-half the distance between mouth 60 of cam groove 56 and a closed end 66 of the cam groove. It also can be seen that detent projection 62 on the actuating lever has moved past detent projection 64 within the actuator connector housing. This release of the detent projections is effected by a release projection 65 on mating connector 14 during mating of the connectors. The connectors are mated (i.e., mating connector 14 is pulled toward actuator connector 12 in the direction of arrow "B") in response to rotation of the actuator lever in the direction of arrow "A".

FIG. 7 shows actuating lever 22 having been pivoted in the direction of arrow "A" about pivot shaft 50 to its operative or fully mated position. Mating connector 14 has been pulled in the direction of arrow "B" to its fully mated position, as cam follower projection 58 moves all the way to the closed end 66 of cam groove 56 in the actuating lever. When the actuating lever reaches its fully mated position, a latch hook 70 at the leading edge of head portion 54 snaps behind a latch shoulder 72 to hold the actuating lever in its operative position and the connectors in their fully mated condition, as shown. In order to unmate the connectors, latch hook 70 is depressed out of engagement with latch shoulder 72, and actuating lever 22 can be pivoted back to its inoperative position shown in FIG. 5, whereby mating connector 14 can be unmated from actuator 12 as cam follower projection 58 is free to move out of mouth 60 of cam groove 56.

From the foregoing, it can be understood that single actuating lever 22 is mounted intermediate opposite sides 18 (FIGS. 1 and 2) of actuator connector housing 16. This locates the actuating lever within the given array of terminals of the connectors as indicated by terminal-receiving passages 24 and terminals 49 of the mating connector. In other words, the open area 46 (FIG. 1) within which the actuating lever is operatable, is located within the array of terminals.

To this end, the invention contemplates that the actuating lever be located generally on the load center-line of the load pattern of terminals. In other words, if the same number of similarly sized and configured terminals are not located on each opposite side of the actuating lever, the load pattern may not be on the geometric centerline of the connector assembly. For instance, an equal number of larger power terminals on one side of the actuating lever would require greater interengaging or mating loads than the same number of smaller signal terminals on the opposite side of the actuating lever. This would create an uneven load pattern, i.e., asymmetrical to the geometric or physical center-line of the connector. In such an instance, the location of the single actuating lever would be located closer to the "high load" side of the connector than to the "low load" side of the connector. In other words, the actuating lever would be located generally on the load center-line of the terminal load pattern rather than physical or geometric center-line of the connectors. In the illustrated embodiment herein, there are equal number of terminals on opposite sides of the actuating lever, and the terminals all are substantially of the same size and configuration resulting in substantially equal individual interengaging loads. Therefore, actuating lever 22 herein is located on the geometric center-line of the connectors which coincides with the load center-line of the terminals.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

What is claimed is:

1. A lever type electrical connector assembly, comprising:

a first connector including a housing having opposite sides, a plurality of first terminals mounted on the housing, and a single actuating lever pivotally mounted on the housing intermediate said opposite sides thereof for pivotal movement about an axis extending in a direction between said sides and including a cam groove therein; and a second connector including a plurality of second terminals for mating with the first terminals of the first connector and having a cam follower projection to be engaged in the cam groove of the single actuating lever whereby the connectors are mated and unmated in response to rotation of the actuating lever.

2. The lever type electrical connector of claim 1 wherein said first terminals are mounted on the housing on opposite sides of the single actuating lever.

3. The lever type electrical connector of claim 1 wherein said first terminals are mounted on the housing in a given terminal array, and the single actuating lever is located within the array of terminals.

4. The lever type electrical connector of claim 1 wherein said first terminals are disposed in an array which has a load pattern upon mating with the second terminals of the second connector, and wherein the single actuating lever is located generally on a load center-line of the load pattern.

5. A lever type electrical connector assembly, comprising:

a first connector including a housing mounting a plurality of first terminals and an actuating lever pivotally mounted on the housing, the lever including a cam groove, and the terminals being located on opposite sides of the lever; and a second connector including a plurality of second terminals for mating with the first terminals of the first connector and having a cam follower projection to be engaged in the cam groove of the single actuating lever whereby the connectors are mated and unmated in response to rotation of the actuating lever.

6. The lever type electrical connector of claim 5 wherein said first terminals are mounted on the housing in a given terminal array, and the actuating lever is located within the array of terminals.

7. The lever type electrical connector of claim 5 wherein said first terminals are disposed in an array which has a load pattern upon mating with the second terminals of the second connector, and wherein the actuating lever is located generally on a load center-line of the load pattern.

8. A lever type electrical connector, comprising:

a housing having opposite sides;

a plurality of terminals mounted on the housing; and a single actuating lever pivotally mounted on the housing intermediate said opposite sides thereof for pivotal movement about an axis extending in a direction between said sides and including engagement means for engaging a complementary mating connector whereby the connectors are mated and unmated in response to rotation of the actuating lever.

9. The lever type electrical connector of claim 8 wherein said terminals are mounted on the housing on opposite sides of the single actuating lever.

10. The lever type electrical connector of claim 8 wherein said terminals are mounted on the housing in a given terminal array, and the single actuating lever is located within the array of terminals.

11. The lever type electrical connector of claim 8 wherein said terminals are disposed in an array which has a load pattern upon mating with appropriate terminals of the complementary mating connector, and wherein the single actuating lever is located generally on a load center-line of the load pattern.

* * * * *